US005257579A

United States Patent [19]

Theurer

[11] Patent Number: 5,257,579

[45] Date of Patent: Nov. 2, 1993

[54] CONTINUOUS ACTION MACHINE FOR COMPACTING BALLAST

[75] Inventor: Josef Theurer, Vienna, Austria

[73] Assignee: Franz Plasser Bahnbaumaschinen-Industriegesellschaft m.b.H., Vienna, Austria

[21] Appl. No.: 637,216

[22] Filed: Jan. 3, 1991

[30] Foreign Application Priority Data

Feb. 6, 1990 [AT] Austria ..... 250/90

[51] Int. Cl.[5] ..... E01B 27/00

[52] U.S. Cl. ..... 104/2; 104/7.1

[58] Field of Search ..... 104/7.1, 7.2, 10, 12, 104/2

[56] References Cited

U.S. PATENT DOCUMENTS

| | | | |
|---|---|---|---|
| 4,046,079 | 9/1977 | Theurer | 104/7.2 |
| 4,064,807 | 12/1977 | Theurer | 104/7.2 |
| 4,066,020 | 1/1978 | Theurer | 104/7.2 |
| 4,356,771 | 11/1982 | Theurer | 104/7.2 |
| 4,643,101 | 2/1987 | Theurer | 104/7.2 |
| 4,953,467 | 9/1990 | Theurer | 104/12 |

OTHER PUBLICATIONS

"How automated track-lining . . . " Railway Track and Structure, pp. 28-30, Sep. 1976.

*Primary Examiner*—Mark T. Le

*Attorney, Agent, or Firm*—Collard & Roe

[57] ABSTRACT

A continuously advancing track working machine for compacting ballast comprises a self-propelled machine frame supported by undercarriages on the track for mobility in an operating direction and a track stabilization assembly vertically adjustably mounted on the machine frame between the undercarriages. The track stabilization assembly comprises drives for vertically adjusting the assembly, oscillatory rolling tools arranged for engaging the rails, vibrators for oscillating the rolling tools, and spreading drives for pressing the rolling tools against the gage sides of the rails. The machine further comprises a leveling reference system including a leveling reference base having a leading and a trailing end point in the operating direction, and a measuring axle carrying a pickup indicating the track level measured by the axle, the measuring axle rolling on the track off-center between the reference base end points and rearwardly of the track stabilization assembly.

4 Claims, 3 Drawing Sheets

CONTINUOUS ACTION MACHINE FOR COMPACTING BALLAST

BACKGROUND OF THE INVENTION

1. Field of the Invention

The present invention relates to a continuously advancing track working machine for compacting ballast supporting a track comprised of two rails fastened to a succession of ties, each rail having a gage side and a field side, which comprises a self-propelled machine frame supported by undercarriages on the track for mobility in an operating direction, a track stabilization assembly vertically adjustably mounted on the machine frame between two of these undercarriages, the track stabilization assembly comprising drive means for vertically adjusting the assembly, oscillatory rolling tools arranged for engaging the rails, vibrating means for oscillating the rolling tools, and spreading drive means for pressing the rolling tools against the gage sides of the rails. The machine further comprises a track leveling reference system including a track level reference base having a leading and a trailing end point in the operating direction, and a measuring axle rolling on the track and carrying a pickup generating a track level indicating signal.

2. Description of the Prior Art

A dynamic track stabilizer of this type for compacting a ballast bed has been disclosed in U.S. Pat. No. 4,064,807, dated Dec. 27, 1977. The vertically adjustable track stabilization assembly runs on the track rails on flanged wheels whose flanges are pressed without play against the gage sides of the rails and laterally pivotal flat rollers are pivoted into engagement with the field sides of the rails to hold the track rails firmly while the assembly is vibrated to impart oscillations to the track in a substantially horizontal plane and a substantially vertically extending load is applied to the assembly by hydraulic vertical adjustment drives. The flanged wheels and the flat rollers constitute the rolling tools of the track stabilization assembly, and the track will be settled by condensing the supporting ballast under the static load while the machine continuously advances along the track. The track level is controlled by a leveling reference system comprised of two tensioned reference wires illustrated.

U.S. Pat. No. 4,046,079, dated Sep. 6, 1977, shows such a dynamic track stabilizer coupled to a track tamping machine. A conventional reference system extends along the track stabilizer and the tamping machine, and its tensioned reference wire is guided without play along the guide rail of the track to indicate and record the existing track position. Any deviations of the existing track position from a desired track position are corrected by lining drives which transversely displace the track. The reference system is aligned principally with respect to the tamping machine.

U.S. Pat. No. 4,643,101, dated Feb. 17, 1987, discloses a continuous action track working machine with an elongated two-part machine frame whose parts are hinged together. The leading machine frame part constitutes a track leveling, lining and tamping machine carrying an operating unit which is longitudinally displaceable relative to the machine frame. The trailing machine frame part carries two track stabilization assemblies and a vertically adjustable track sensing element is guided along the track between the two assemblies. A contact at the upper end of the track sensing element is associated with a tensioned reference wire of a leveling reference system associated with each track rail. A tensioned reference wire of a lining reference system extends centrally between the rails from the leading to the trailing end of the machine frame, and another track sensing element at the operating unit cooperates with the lining reference wire to control the lining operation.

SUMMARY OF THE INVENTION

It is the primary object of this invention to provide a continuous action track working machine of the first-described type for compacting ballast and which enables the track to be accurately leveled while the horizontal and transversely oriented oscillations and the vertical pressure imparted to the track cause the track to be settled in the condensed ballast.

The above and other objects are accomplished according to one aspect of the invention with such a track working machine by arranging a track level measuring axle carrying a pickup indicating the track level measured by the axle and rolling on the track off-center between the reference base end points and rearwardly of the track stabilization assembly in the operating direction. Preferably, the measuring axle carries a respective one of the pickups associated with each track rail and indicating the level of the associated track rail.

This positioning of the measuring axle of the track leveling reference system for the first time enables a conventional dynamic track stabilizer to be used as a track leveling machine which produces an accurate track level which can be monitored and controlled in the transition ramp area formed between the existing and the desired track level by the ballast compaction produced by the track stabilization assembly. In this manner, the track level can be advantageously accurately monitored at a point where the track has been settled almost at the desired level, on the one hand, while any divergence between the computed desired level and the level measured by the measuring axle can be corrected at this point, on the other hand. This can be done very quickly and effectively by changing the static load exerted upon the track stabilization assembly by the vertical drive means. Furthermore, this positioning of the measuring axle behind the track stabilization assembly has the added advantage of reducing any track level errors resulting from a location of the leading reference base end point on a track level error point.

According to another aspect of the present invention, a track is continuously lowered from an existing to a desired level with a track working machine advancing along the track, which comprises the steps of measuring the existing track level and computing an ideal desired track level on the basis of the measured track level, subsequently imparting horizontal oscillations to the track while applying a vertical static load thereto until the track has been lowered to the desired level, and controlling the lowering of the track to the desired level by changing at least one operating parameter selected from the group consisting of the applied vertical static load, the speed of the advancing track working machine and the frequency of the horizontal track oscillations in proportion to the magnitude of the deviation of the existing track level from the desired track level.

This makes it possible for the first time to use a dynamic track stabilizer directly for accurate track leveling instead of its auxiliary use for uniformly settling a previously leveled track. Contrary to the operation of a track leveling and tamping machine used for track leveling by controlling the track lifting forces, the track lowering forces are controlled in the method of this invention. This leveling method has the particular advantage that it can be performed continuously during the advance of the track working machine along the track, preferably by changing the applied vertical static load from a standard load applied to the track along an entire section of the track to be lowered to the desired level. The standard load corresponds to an average desired settling of the track in the compacted ballast along the entire track section, and this load is proportionally increased or reduced at high or low points. At the end of the operation, the track will be settled in the compacted ballast at the desired level.

According to a preferred feature, two track stabilization assemblies are sequentially arranged in the operating direction and linked to the machine frame by respective drive means, and a further measuring axle is arranged between the track stabilization assemblies. Two measuring axles positioned in this manner enable a constant proportion between the two measured track levels to be obtained. This has the particular advantage that a track level error occurring at the leading end point of the reference base does not produce an error at the measuring point.

Preferably, the machine comprises yet another measuring axle arranged between the leading reference base end point and a leading one of the track stabilization assemblies. The pickups of the trailing and the other measuring axles define a rectilinear line on which the pickup of the further, intermediate measuring axle must lie. In this manner, any errors resulting from track level errors at the leading and trailing end points of the reference base are compensated.

BRIEF DESCRIPTION OF DRAWING

The above and other objects, advantages and features of the present invention will become more apparent from the following detailed description of certain now preferred embodiments thereof, taken in conjunction with the accompanying, somewhat diagrammatic drawing wherein.

DETAILED DESCRIPTION OF PREFERRED EMBODIMENTS

Figure 1:
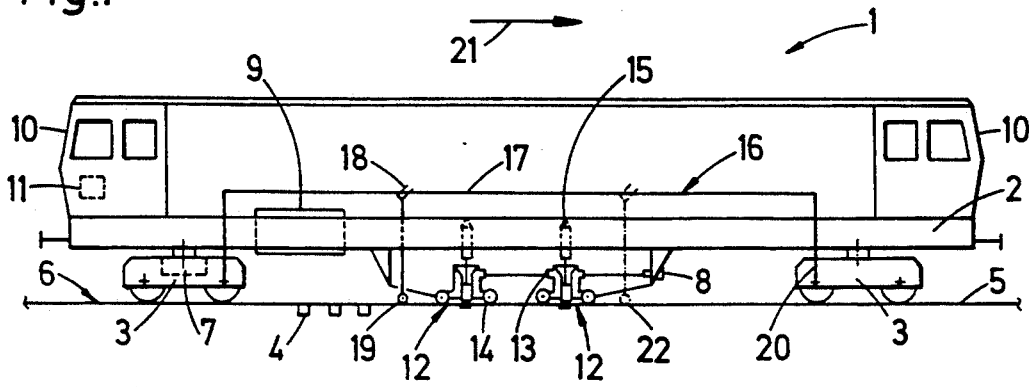
FIG. 1 is a side elevational view of a track working machine according to this invention.

Referring now to the drawing and first to FIG. 1, there is shown track working machine 1 continuously advancing in an operating direction indicated by arrow 21 for compacting ballast supporting track 6 comprised of two rails 5 fastened to a succession of ties 4, each rail having a gage side and a field side. The illustrated machine is known as a dynamic track stabilizer and comprises a self-propelled, rigidly structured machine frame 2 supported at respective ends thereof by undercarriages 3, 3 on the track for mobility in an operating direction indicated by a horizontal arrow. Central power plant 9 is mounted on machine frame 2 and supplies power to drive 7 for propelling the machine, vibrating drive 8 for vibrating track stabilization assemblies 12, 12 and any other operating drives of the machine. The illustrated undercarriages are swivel trucks, and pivotal frames mount sound-proof operator's cabs 10, 10 on machine frame 2 at respective ends thereof above the swivel trucks. A central control, computer and recording unit 11 is provided for controlling the drives and processing the measuring signals.

In the illustrated embodiment of track working machine 1, two track stabilization assemblies 12, 12 are vertically adjustably mounted on the machine frame between the two undercarriages 3, 3, and each track stabilization assembly comprises hydraulic drive means 15 linking the assembly to machine frame 2 for vertically adjusting the assembly, oscillatory rolling tools 14, 14 arranged for engaging rails 5, 5, vibrators 13 for oscillating the rolling tools, and spreading drive means for pressing rolling tools 14, 14 against the gage sides of rails 5, 5. Hydraulic drives 15 are operable to exert a static load on track stabilization assemblies 12, 12.

The track working machine further comprises leveling reference system 16 including tensioned reference wires 17 associated with, and extending above, each track rail and cooperating with track level pickups 18 mounted on measuring axle 19 rolling on track 6 and emitting an output signal corresponding to the track level indicated by the measuring axle and controlling the level of the track settled by operation of track stabilization assemblies 12, 12. Each tensioned wire constitutes a reference base which extends between leading and trailing end point 20 vertically adjustably mounted on machine frame 2 and supported in the axle bearings of undercarriages 3, 3. Track level measuring axle 19 carries flanged wheels supporting the axle on the track rails and is vertically adjustably supported on machine frame 2 off-center between the reference base end points and rearwardly of the track stabilization assemblies in the operating direction.

As indicated in broken lines, the machine may also carry a like measuring axle 22 at the other side of the track stabilization assemblies so that track working machine 1 may be operated in the opposite direction while measuring axle 19 is lifted off the track.

Figure 2:
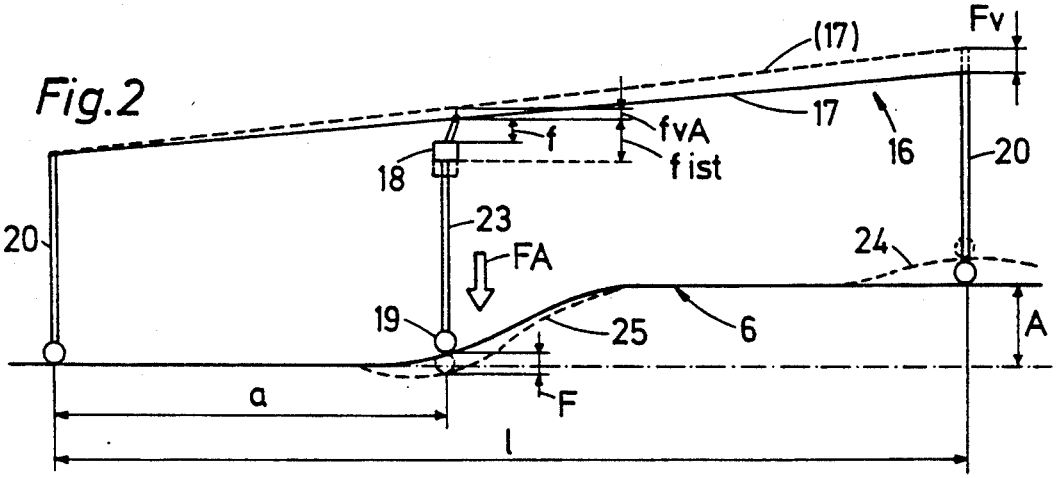
FIG. 2 is a schematic illustration of the track leveling reference system.

As shown in FIG. 2, leading and trailing end points 20 of leveling reference system 17 are guided on the rails of track 6 and thus sense or monitor the track level, as schematically represented by rollers engaging the track rails and corresponding to the wheels of swivel trucks 3. Rail level sensing device 23 is constituted by a rod which is vertically adjustably mounted on machine frame 2 and whose lower end is affixed to measuring axle 19 running on rollers on the track rails while its upper end carries level pickup device 18 which may be a rotary potentiometer engaging tensioned level reference wire 17. a indicates the predetermined average or standard lowering of track 6 into a desired position by operation of dynamic track stabilizers 12. The distances of track level sensor 23 and leading track level sensor 20 from trailing track level sensor 20 are indicated by a and l, respectively. The vertical static load applied to track 6 by track stabilization assemblies 12 is indicated by the arrow FA.

In operation, the vertical static load is so controlled that the difference between the desired track level and the existing track level picked up by device 18 is zero, this control being effectuated by controlling the hydraulic pressure in drives 15. The average or standard load, i.e. the pressure in hydraulic cylinders 15, is so adjusted that track 6 is, on the average, lowered by distance A. If measuring axle 19 senses a high point above the desired average level, load FA is proportionally increased to level this track point. On the other hand, where the existing track level is lower than the desired average level, the static vertical load is decreased proportionally. The same effect could be obtained by controlling the frequency of oscillations, i.e. the vibrators of the track stabilization assemblies, the track being lowered to the greatest extent in the frequency range of 30 to 40 Herz, as well as by controlling the forward speed of machine 1, i.e. drive 7.

Since leading end point 20 of leveling reference base 17 senses the track level in a still uncorrected track section, it is assumed that it is at a high point of the track, indicated by broken line 24. This results in false level Fv of leading track level sensor 20. This produces false level pickup fvA at track level sensor 23, simulating corresponding depression 25 (indicated in broken lines). False level pickup fvA can be exactly calculated by the formula $fvA = Fv \times a/l$.

With a predetermined desired track level and any deviations therefrom of the existing track level sensed by measuring axle 19 and picked up by device 18, false level Fv at the leading end point of the reference base can be automatically compensated by the input of corresponding correction value fvA in the electronic track leveling control. Thus, such an error at measuring axle 19 remains without influence on the track level correction.

The desired track level may be predetermined, for example, with track working machine 1 in the following manner:

Using the machine as a track measuring or survey car, the existing level of track 6 may be measured and recorded. A conventional computer program in computer 11 then computes the desired track level on the basis of the measured track level data. The machine is then used as a dynamic track stabilizer to lower and settle the track, simultaneously using it as a track leveling machine by generating suitable control signals determined by leveling reference system 16 in the above-indicated manner.

It is also possible that the local railroad provides a desired track geometry. In this case, the corresponding track level data are given to the machine operating personnel and are put into computer 11. Furthermore, the operating personnel may manually measure the existing track level with optical instruments, for example, before the track leveling operation. The computed correction values are then used for leveling.

Figure 3:
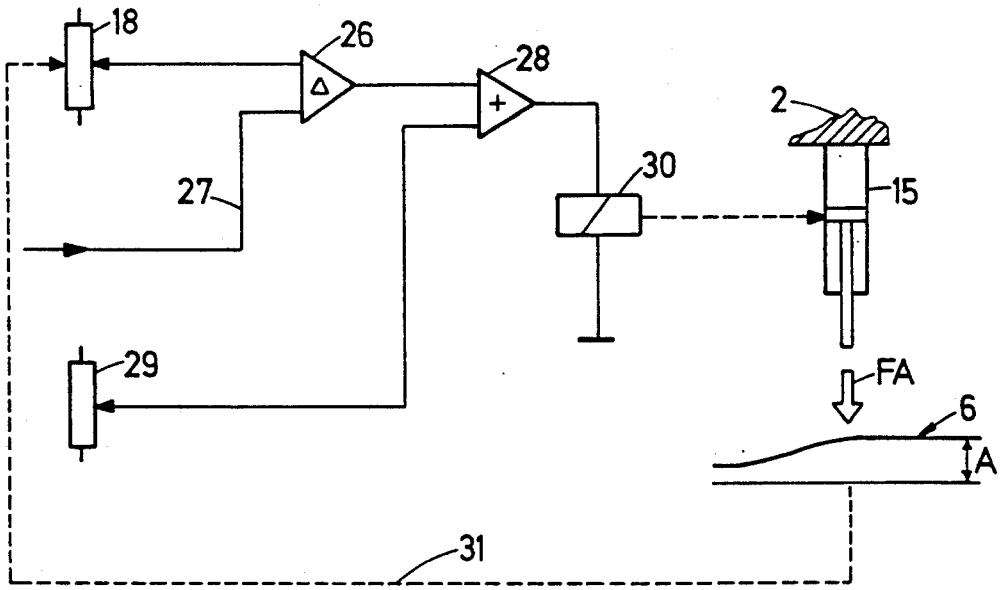
FIG. 3 is a diagram of the control circuit of the leveling reference system.

The electrical control circuit diagram of FIG. 3 shows track level pickup device 18, which is a rotary potentiometer, continuously receiving the existing level of track 6 as machine 1 continuously advances, and transmitting a corresponding output signal to differential amplifier 26, which also receives correction signal Δ fvA through conduit 27. The corrected existing track level value signal is constituted by the difference between the existing track level value signal emitted from pickup device 18 and the correction signal, and this corrected value signal is transmitted to adder 28 which is connected to adjustable potentiometer 29 controlling the average or standard vertical static load for obtaining lowering A of track 6. The output of adder 28 is connected to hydraulic adjustment element 30, i.e. a servovalve, controlling the hydraulic pressure in drives 15 for adjusting track stabilization assemblies 12 vertically in proportion to the output signals of adder 28. The circuit is closed by conduit 31 (indicated in broken lines) leading from measuring axle 19, which engages the track, to track level pickup 18.

Figure 4:
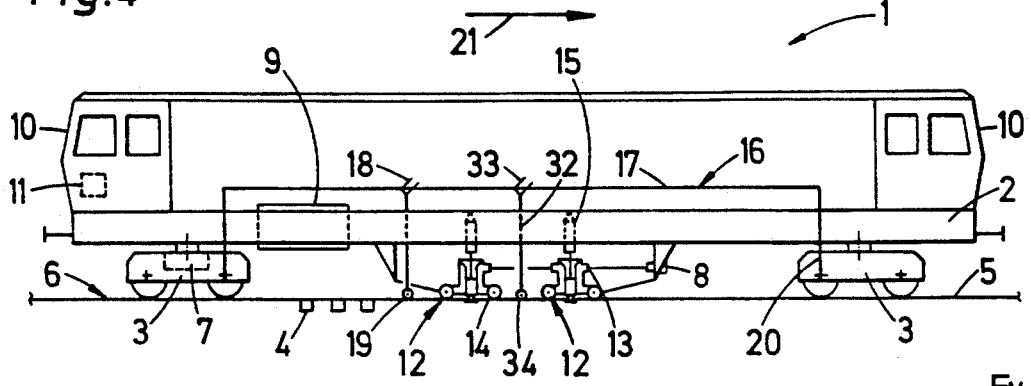
FIG. 4 is a side elevational view of another embodiment of a track working machine according to the invention.

Track working machine 1 of FIG. 4 is identical to that of FIG. 1, like reference numerals designating like parts operating in a like manner, except for the incorporation of further existing track level sensor 32 arranged between the two sequentially arranged track stabilization assemblies 12, 12. This is identical with the off-center track level sensor and comprises measuring axle 34 running on track 6 and existing track level pickup device 34.

Figure 5:
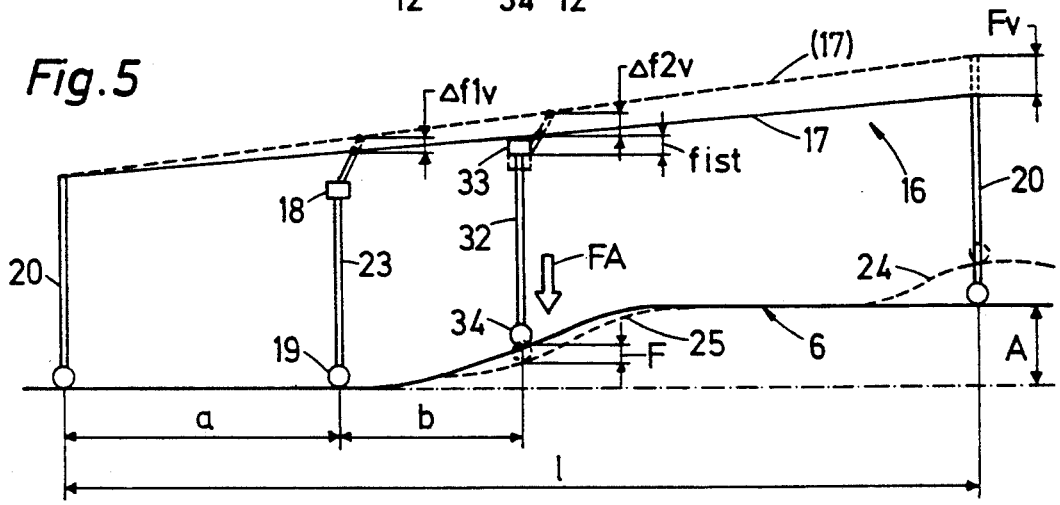
FIG. 5 is a schematic illustration of the track leveling reference system of FIG. 4.

Its track leveling reference system 16 is illustrated in FIG. 5 and is based on a constant relation between the two track level pickups 18 and 33, defined by:

$$i = f1/f2 = a/(a+b)$$

$$\Delta f2v = i \times \Delta f1v$$

This system has the advantage a track level error sensed at leading end point 20 of reference base 17 does not result in a corresponding error at track level sensor 32.

Figure 6:
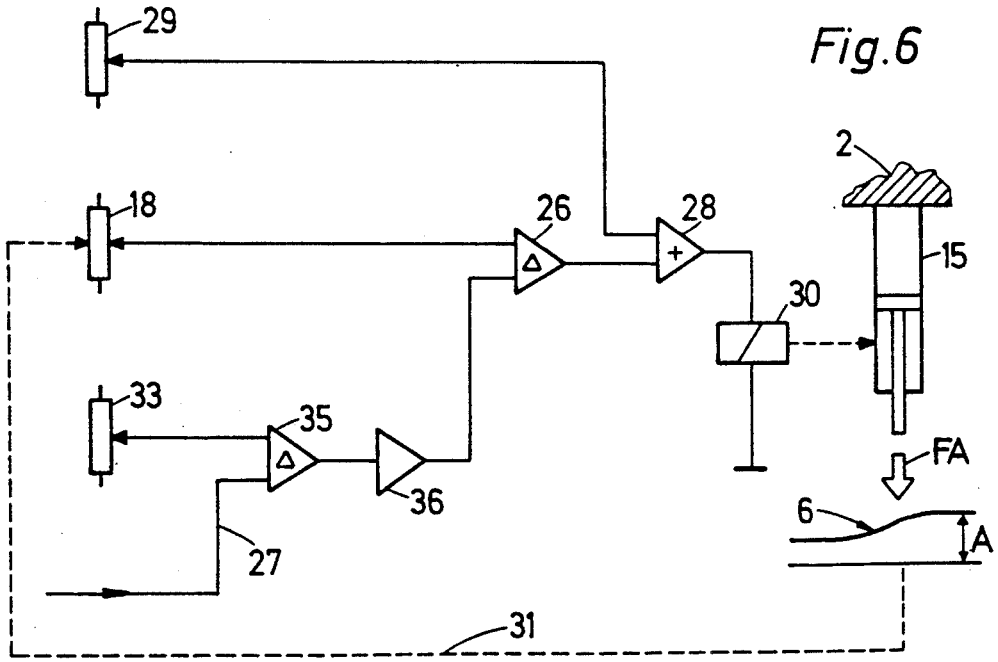
FIG. 6 is a diagram of the control circuit of the leveling reference system of FIGS. 4 and 5.

The control circuit of FIG. 6 differs from that of FIG. 3 by the addition of existing track level pickup 33, differential amplifier 35 and amplifier 36 connected thereto and transmitting the amplified differential signal from amplifier 35 to differential amplifier 26. Conduit 27 feeds correction signal $\Delta f1v = Fv \times a/l$ to differential amplifier 35, and its output signal is amplified in amplifier 36 by value i. Differential amplifier 26 has a first input receiving this amplified signal and a second input receiving the existing track level signal from pickup 18. Amplifier 26 generates an output signal corresponding to the corrected existing track level value and this corrected value signal is transmitted to adder 28 which is connected to adjustable potentiometer 29 controlling the average or standard vertical static load for obtaining lowering A of track 6.

Figure 7:
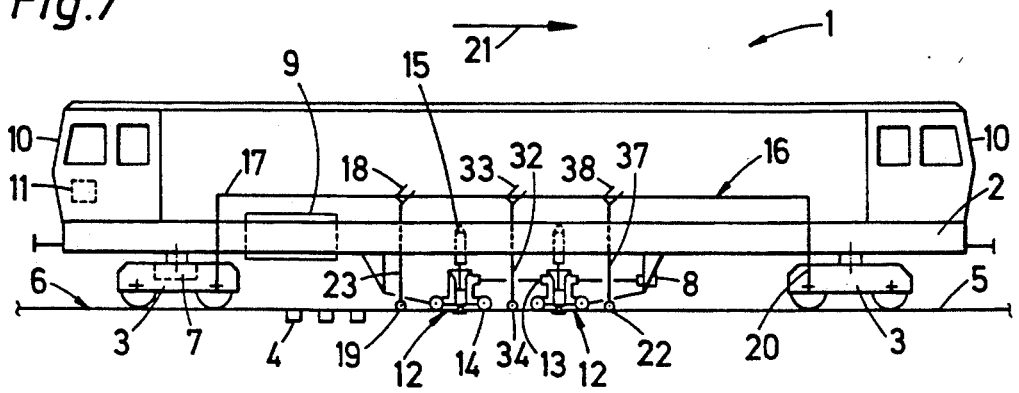
FIG. 7 is a side elevational view of yet another embodiment of a track working machine according to the invention.

Track working machine 1 of FIG. 7 is the same as that of FIG. 4, except that yet another track level sensor 37 is arranged on the machine in front of the track stablization assemblies, in the operating direction. Again, the track level sensor has a measuring axle 22 running on track 6 and existing track level pickup 38.

Figure 8:
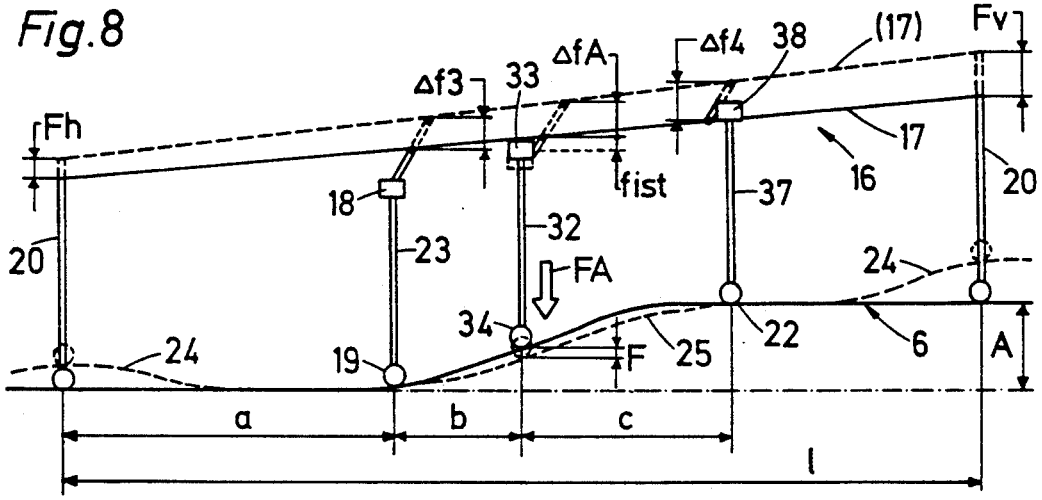
FIG. 8 is a schematic illustration of the track leveling reference system of FIG. 7.

As shown in FIG. 8, the two track level pickups 18 and 38 at respective sides of track stabilization assemblies 12, 12, respectively trailing and leading the same, define a rectilinear reference base 17, and track level pickup 33, which is centered between the track stabilization assemblies, is arranged on this reference base. This automatically compensates for errors Fv and Fh at the leading and trailing end points of track leveling reference system 17. The desired level fA at center track sensor 32 is computed by the following formula:

$$fA=(f3\times c+f4\times b)/(b+c),$$

wherein f3 corresponds to the ordinate at rear track level sensor 23 and f4 to that of leading track level sensor 37. F indicates the error at the simulated lowering of the track at center track level sensor 32 and fist indicates the actual existing track level error. If the desired and corrected track level values are taken into account in the track leveling operation of machine 1, the errors at track level pickup 38 are fully compensated.

Figure 9:
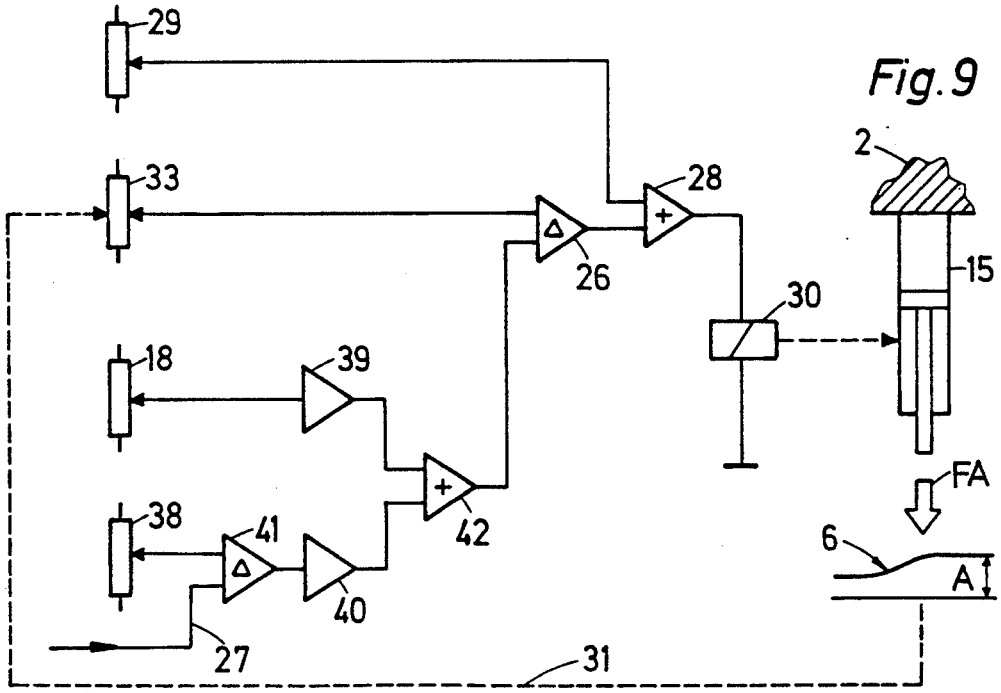
FIG. 9 is a diagram of the control circuit of the leveling reference system of FIGS. 7 and 8.

In the control circuit of FIG. 9, using the same reference numerals as FIGS. 3 and 6 to designate like parts operating in a like manner, existing track level pickup 33 generates a corresponding output signal transmitted to differential amplifier 26. Pickup 18 generates an output signal corresponding to track level value f3 which is amplified by factor c/b+c in amplifier 39, and this amplified signal is transmitted to one input of adder 42. Pickup 38 generates an output signal corresponding to track level value f4 and the differential signal between the output signal of pickup 38 and a correction value fed to differential amplifier 41 is transmitted to amplifier 40 where it is amplified by factor b/b+c. This amplified signal is transmitted to a second input of adder 42, whose output signal is transmitted to differential amplifier 26 as the desired value signal. Amplifier 26 generates an output signal corresponding to the corrected existing track level value and this corrected value signal is transmitted to adder 28 which is connected to adjustable potentiometer 29 controlling the average or standard vertical static load for obtaining lowering A of track 6. Hydraulic drives 15 of track stabilization assemblies 12 are controlled by the output signal of adder 28 in the manner described in connection with FIG. 3.

What is claimed is:

1. A continuously advancing track working machine for compacting ballast supporting a track comprised of two rails fastened to a succession of ties, each rail having a gate side and a field side, which comprises (a) a self-propelled machine frame supported by undercarriages on the track for mobility in an operating direction, (b) two track stabilization assemblies vertically adjustably mounted on the machine frame centrally between two of said undercarriages and sequentially arranged in the operating direction, each track stabilization assembly comprising (1) drive means for vertically adjusting the assembly, (2) oscillatory rolling tools arranged for engaging the rails, and (3) vibrating means for oscillating the rolling tools, and (c) a leveling reference system including (1) a leveling reference base having a leading and a trailing end point in the operating direction, and (2) a measuring axle supported on the track at a distance from a respective one of the track stabilization assemblies and carrying a pickup indicating the track level measured by the axle, the measuring axle rolling on the track off-center between the reference base end points and rearwardly of the respective track stabilization assembly in the operating direction.

2. The track working machine of claim 1, wherein the measuring axle carries a respective one of the pickups associated with each track rail and indicating the level of the associated track rail.

3. The track working machine of claim 1, comprising a further one of the measuring axles arranged between the track stabilization assemblies.

4. The track working machine of claim 3, comprising yet another one of the measuring axles arranged between the leading reference base end point and a leading one of the track stabilization assemblies.

* * * * *